United States Patent [19]

Rhodes

[11] Patent Number: 4,606,400

[45] Date of Patent: Aug. 19, 1986

[54] ELEMENT BASKET FOR HEAT EXCHANGER

[75] Inventor: Robin B. Rhodes, Wellsville, N.Y.

[73] Assignee: The Air Preheater Company, Inc., Wellsville, N.Y.

[21] Appl. No.: 744,177

[22] Filed: Jun. 13, 1985

[51] Int. Cl.[4] ..... F28D 19/04

[52] U.S. Cl. ..... 165/10; 165/5

[58] Field of Search ..... 165/10, 5

[56] References Cited

U.S. PATENT DOCUMENTS 4,331,198 5/1982 Michalska ..... 165/10

4,345,640 8/1982 Cullinan ..... 165/10

*Primary Examiner*—Albert W. Davis, Jr.

*Attorney, Agent, or Firm*—William W. Habelt

[57] ABSTRACT

An element basket for a rotary regenerative heat exchanger having an array of heat absorbent plates that comprise heat transfer elements therefor. Retaining means are affixed at opposite ends to basket walls to positively position the element plates within the basket. The element plates have curved recesses at opposite ends thereof to receive the retaining means, the recesses having a dimension greater than that of a transverse section of the adjacent retaining means to permit freedom of movement therebetween and to preclude a concentration of stresses that would effect premature failure thereof.

2 Claims, 3 Drawing Figures

ELEMENT BASKET FOR HEAT EXCHANGER

BACKGROUND AND SUMMARY OF THE INVENTION

The present invention relates generally to heat exchange apparatus and specifically to an element basket for a rotary regenerative heat exchange apparatus including means for retaining element plates within the basket while permitting relative movement between the plates thus preventing premature breakage of the element plates.

In rotary regenerative heat exchange apparatus, a mass of heat absorbent material commonly comprised of element plates is first positioned in a hot gas passageway to absorb heat from a stream of hot gases passing therethrough. As the heat absorbent material becomes heated by the hot gases, it is slowly moved into a second passageway where the heated plates transmit their absorbed heat to cooler air passing therethrough.

The apparatus of a rotary regenerative heat exchanger is commonly comprised of a cylindrical drum packed with heat absorbent plates, the rotor then slowly rotated about its axis to permit alternate contact with hot gas and cooler air. As the plates are contacted by the flow of air and gas, they corrode and erode until they occupy less space in the basket, thus becoming less tightly packed and becoming subject to vibration and ultimate breakage by the aerodynamic forces of the air and gas flowing through the rotor.

Severe vibration often results in premature breakage of the element plates so that the heat exchanger quickly loses its effectiveness. Although the heat absorbent plates are commonly contained in sector-shaped baskets that may be individually repaired or replaced as required, the operation of replacement usually requires that the heat exchanger be completely shut down and removed from service until repair is complete.

Another cause of plate deterioration and breakage is the application of concentrated stresses to points formed by sharply bending or cutting the plates to conform to their physical relationship with other plates or retaining bars within the basket.

Various arrangements have been developed to preclude the shifting of plates and thus prolong their effectiveness. One highly effective construction is seen in U.S. Pat. No. 3,314,472 where the heat absorbent plates are spring loaded to preclude their lateral movement or vibration. Another arrangement shown in U.S. Pat. No. 3,379,240 discloses a method of actually bending the individual element plates to effect a spring action which maintains the plates in a permanently tight relationship.

In U.S. Pat. No. 4,345,640 restraining bars are tightly recessed into ends of a series of element plates, the bars then being affixed to opposite walls of a basket so as to restrain the individual plates both endwise and transversely. To effect a complete restraint, the element plates are provided squarecornered recesses, the edges of the recesses in said plates tightly contacting the edges of the restraining bars. When the plates are subjected to the action of the moving air and gas, all vibration is at first precluded by the restraining bars. As the element plates deteriorate by prolonged exposure to the corrosive and erosive effects of the gas and air, they gradually occupy less space in the basket while the recesses in the plates gradually become larger. Thus, the plates loosen in the basket and begin to vibrate increasingly which may lead to cracking under stress at their square-cornered recesses and eventually result in the plates breaking apart and failing completely.

Although breakage of the element plates is caused primarily by vibrations generated by the flowing air and gas and the corrosiveness of the gas, it is hastened by distortion of the restraining bars tightly fitting into the recesses of the plates. Inasmuch as the bars have no margin of movement within the tightly fitting recesses of the plates, expansion and warping of the bars causes additional stress to be placed upon the element plates at the sharp corners of said recesses. Thus, cracking soon occurs and complete failure of the individual plates follows.

SUMMARY OF THE INVENTION

The present invention is directed to an arrangement that precludes stress cracking, and resultant breakage of the element plates, while permitting the use of retaining bars that extend freely through the recesses formed in the ends of the elements plates to hold the plates in position. In accordance with the invention, the recesses are formed with a dimension greater than that of an adjacent cross-section of the retaining bar passing therethrough in order that there may be limited relative movement therebetween. Moreover, the difference in size will permit the formation of rounded corners in each recess of the element plates to reduce stress concentration. Furthermore, the arrangement defined will permit less critical positioning during assembly, thereby resulting in a more rapid and cost effective process of manufacture.

DESCRIPTION OF A PREFERRED EMBODIMENT OF THE INVENTION

Figure 1:
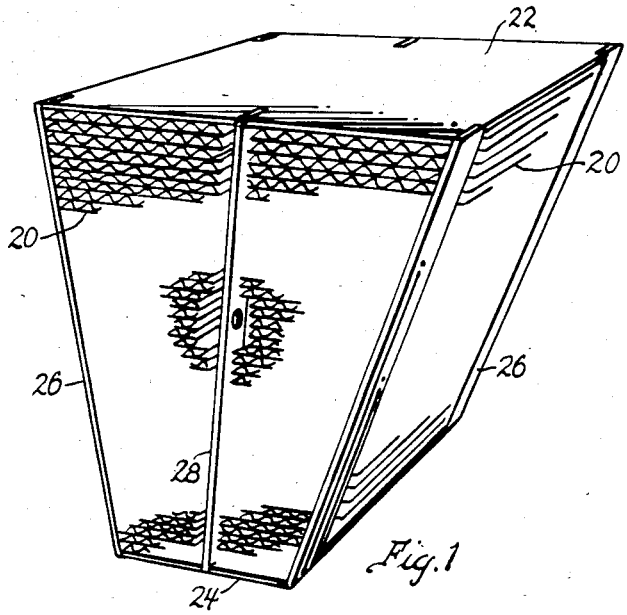

FIG. 1 depicts an element basket for a rotary regenerative heat exchange device as defined by U.S. Pat. No. 3,314,472 wherein a cylindrical rotor shell contains a series of sector shaped compartments, each of which is adapted to receive a basket of heat absorbent element.

The heat absorbent element carried by the rotor generally comprises an array of element plates 20 formed with undulations or other projections that provide extended surface for the plates and simultaneously define flow passageways therebetween for the alternate flow of the hot gas and cooler air. The element plates are positioned in an orderly array in a sector shaped basket or frame that holds them in a substantially fixed relationship. The basket of plates may then be easily handled as an integral element mass for arrangement in the heat exchanger.

Each basket essentially comprises a pair of end plates 22, 24 spaced apart at the inner and outer ends thereof and connected by side bars or straps 26 that hold the element plates therebetween. Additionally, each bundle of element plates is further restrained within the basket by at least one inner retaining bar 28 which is welded at its ends to end plates 22, 24.

Figure 2:
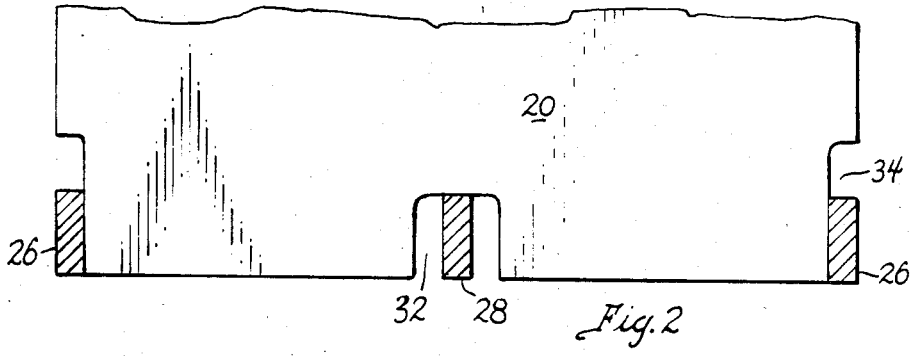

Referring now to FIG. 2, the element plates 20 are formed with a recess **32*a* for each inner retaining bar 28 and side recesses 32*b* for the side bars 26. Each side recess 32*b* is made to conform to the thickness of the bar 26, while being greater than the width of the bar 26 to provide a space 34 that permits limited room for a differential expansion. The space 34 also accommodates the formation of rounded corners in the side recesses 32*b* of the plates to avoid the concentration of stresses that are attendant with square corners and which promote cracking and breakage, The central recess 32***a* for inner bar 28 has the same depth as that of bar 28, but is somewhat wider than the corresponding thickness of the inner retaining bar so as to provide support therefor while permitting a degree of lateral movement therebetween. The greater width of the recess also provides a spacing 35 which permits the formation of rounded corners to greatly reduce the concentration of stress and resultant breaking and premature failure of the element plates associated with square corners.

Figure 3:
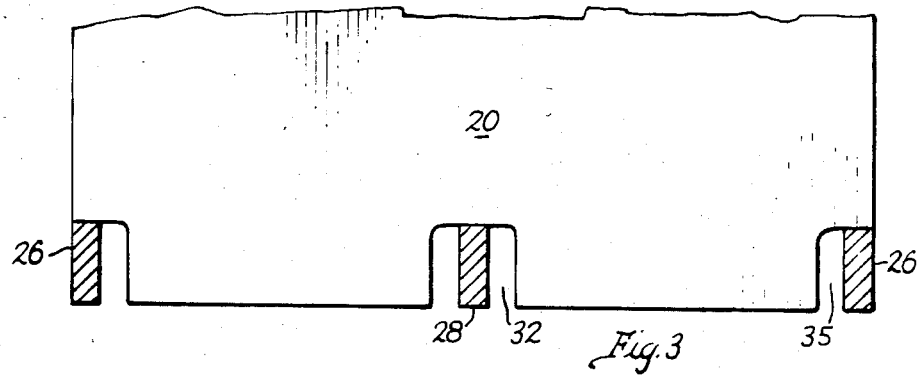

FIG. 3 shows a slight modification in the recesses at the sides of each element plate. Here the recesses are wider than the thickness of bars 26 to provide a space 35 which permits relative lateral movement and the formation of rounded corners of each recess.

The recess in element plate 20 adjacent bar 28 also provides room for a lifting arrangement to engage a hole in bar 28 to facilitate lifting or movement with a hook or other means.

In accordance with the present invention, each recess in the element plates is thus sized with a dimension greater than a corresponding dimension of a retaining bar passing therethrough to permit relative movement between the retaining bar and the element plates. Further, in accordance with the present invention, each recess in the element plates is formed with rounded corners to preclude stress concentration at the corners of the recesses.

What is claimed is:

1. An element basket for a rotary regenerative heat exchanger having an open-ended frame that encloses a plurality of heat transfer element plates packed therein in spaced relationship to provide a series of passageways therethrough for the flow of fluid between the plates, the ends of said plates having aligned recesses formed in the ends thereof that extend transverse to the plates to form a transverse groove, and retaining bars lying within said groove secured at opposite ends thereof to said frame to maintain the plates securely within the frame, characterized in that:

a. the aligned recesses formed in each of the element plates comprise substantially U-shaped recesses having a dimension greater than a corresponding dimension of an adjacent segment of the retaining bars lying therein whereby relative movement between the retaining bars and the element plates may occur; and b. each of the aligned recesses in the element plates has rounded corners that lie spaced from the retaining means lying in said groove.

2. An element basket for a rotary regenerative heat exchanger as defined in claim 1 wherein the width of a recess as measured along a line parallel to the edge of an element plate is greater than the width of a corresponding segment of the retaining means that lies within said groove.

* * * * *